United States Patent [19]

Kohl et al.

[11] Patent Number: 4,953,254

[45] Date of Patent: Sep. 4, 1990

[54] SPRAY EXTRACTOR

[75] Inventors: Albert Kohl, Solothurn, Switzerland; Roland Schunter, Lorch-Waldhausen, Fed. Rep. of Germany

[73] Assignee: Henkel Kommanditgesellschaft auf Aktien, Duesseldorf, Fed. Rep. of Germany

[21] Appl. No.: 451,844

[22] Filed: Dec. 15, 1989

Related U.S. Application Data

[63] Continuation-in-part of Ser. No. 372,108, Jun. 28, 1989, abandoned, which is a continuation of Ser. No. 199,968, May 27, 1988, abandoned.

[30] Foreign Application Priority Data

May 29, 1987 [DE] Fed. Rep. of Germany ..... 3718166

[51] Int. Cl.[5] ..... A47L 11/30

[52] U.S. Cl. ..... 15/320; 15/322; 15/339; 15/354

[58] Field of Search ..... 15/320, 321, 322, 339, 15/354, 379

[56] References Cited

U.S. PATENT DOCUMENTS

| | | | |
|---|---|---|---|
| 3,496,592 | 2/1970 | Jones | 15/321 |
| 3,959,846 | 6/1976 | Yasuda | 15/354 X |
| 3,981,596 | 9/1976 | Melton | 401/48 |
| 4,167,799 | 9/1979 | Webb | 15/359 X |
| 4,318,202 | 3/1982 | Holman | 15/354 X |
| 4,353,145 | 10/1982 | Woodford | 15/321 |
| 4,466,155 | 8/1984 | Grave | 15/321 |
| 4,586,208 | 5/1986 | Trevarthen | 15/321 X |
| 4,616,378 | 10/1986 | Berfield et al. | 15/353 |

FOREIGN PATENT DOCUMENTS 1503758 9/1969 Fed. Rep. of Germany .

*Primary Examiner*—Chris K. Moore

*Attorney, Agent, or Firm*—Ernest G. Szoke; Wayne C. Jaeschke; Real J. Grandmaison

[57] ABSTRACT

A mobile cleaner apparatus comprising a container for a cleaning preparation and an associated pressure pump which are integrated into a mobile and steerable chassis. The chassis has a steering handle and a holder for a removable suction unit equipped with an integrated soil container. A coupling means is provided for detachably fastening to the chassis a spray nozzle and suction nozzle unit having its own roller. The spray nozzle and suction nozzle unit is displaceable laterally on either side of the apparatus. The spray nozzle is suitable for applying a cleaning preparation to a surface to be cleaned, for example, a floor, and the suction nozzle is suitable for sucking up the applied cleaning preparation.

12 Claims, 3 Drawing Sheets

SPRAY EXTRACTOR

BACKGROUND OF THE INVENTION

This application is a continuation-in-part application of U.S. Ser. No. 07/372,108 filed on June 28, 1989, and now abandoned, which is a continuation of U.S. Ser. No. 07/199,968 filed on May 27, 1988, now abandoned.

1. FIELD OF INVENTION

This invention relates to a mobile cleaner apparatus comprising separate containers for a cleaning preparation and for soil, a spray nozzle for spraying the cleaning preparation onto a surface to be cleaned and a suction nozzle for sucking back the applied, soiled cleaning preparation, the container for the cleaning preparation together with an associated pressure pump for applying the cleaning preparation being integrated into a mobile and steerable chassis.

2. STATEMENT OF RELATED ART

A floor cleaner apparatus of the type herein is described in German Patent Application NBo. 23 28 941. In this known floor cleaner system, all the functions and containers are integrated into a single two-wheeled buggy with a steering handle. Accordingly, such a cleaner system is designed solely as a special-purpose device for specific cleaning functions. German Patent Application 24 49 021 describes a portable floor cleaner device of a similar type which likewise can only be used for the particular purpose for which it was designed. The two known devices only have a single-axle undercarriage to enable the user to adapt the angle of inclination of the spray nozzles and suction nozzles to meet individual requirements. However, in the cleaning of large areas, for which these special-purpose devices are actually designed, the continuous adjustment of the pitch angle leads to early fatigue.

Another cleaner device is described in German Patent Application No. 34 45 200. This cleaner device, in the form of a so-called spray extractor, is disclosed as consisting essentially of three parts, namely an operating part, a suction container and a spray part. These three parts are each indicated as being box-like and arranged separably from one another in three parallel planes lying vertically one above the other. The component parts are adapted to be dismantled and reassembled to enable the device to be converted in a few steps into a compact, separate wet and dry vacuum cleaner. However, a major disadvantage of the known device is that, to enable the spray and suction parts to be used separately, separate spray and suction nozzles, each with separate feed lines, have to be provided. In addition to the complicated effort arising out of two separate nozzles, the user has to pull the buggy accommodating the suction and pressure units and the associated containers behind him or her.

DESCRIPTION OF THE INVENTION

Other than in the operating examples, or where otherwise indicated, all number expressing quantities of ingredients or reaction conditions used herein are to be understood as modified in all instances by the term "about".

An object of the present invention is to provide a mobile cleaner apparatus in such a way that, although the suction unit may be used separately, effortless cleaning of even relatively large areas is possible where the spray unit is used together with the suction unit simply by pushing along a single buggy always having the same, optimal upward pitch angle both for the spray nozzles and for the suction nozzles. Even where the spray and suction nozzle unit is fixedly connected to the buggy accommodating the associated units and containers, the floor may still be cleaned to the most remote corners of the room.

The solution provided by the invention for the aforementioned mobile cleaner apparatus wherein the container for the cleaning preparation and the associated pressure pump are integrated into a mobile and steerable chassis, is characterized in that the chassis comprises a holder for a suction unit with an integrated soil container and a coupling means for detachably fastening to the chassis a spray and suction nozzle unit having its own roller. According to the invention, the coupling means for fastening the spray and suction nozzle unit to the chassis of the cleaner apparatus comprises a fastening rail or bar fixed to the lower front side of the chassis. The fastening rail or bar extends substantially across the entire front side of the chassis. In addition, the coupling means for the spray and suction nozzle unit includes a clamp block to hold or fasten the spray and suction nozzle unit onto the fastening rail or bar. The clamp block has a groove therein designed to slide onto the fastening rail or bar and is secured thereto by a screw. The clamp block is provided with a bore through which a rod and shaft are inserted and secured by a screw to secure a mounting frame to the clamp block. The mounting frame is also fixed to the housing of the spray and suction nozzle unit. In this manner, the spray and suction nozzle unit may be adjustably displaced on the fastening rail or bar, that is, it may be shifted to the left side or to the right side of the chassis to enable spraying and suction on either of said sides if desired.

The invention provides a cleaner apparatus with a mobile and steerable chassis for the integrated accommodation of a wash liquor tank and a pressure pump which has a place for the removable introduction of a suction unit having a soiled-water container. The suction unit may therefore be used as a separate wet or dry vacuum cleaner. However, in combination with the cleaner apparatus according to the invention, the suction unit has a connection to a common spray and suction nozzle unit which is designed to be fastened to the aforementioned coupling means of the mobile cleaner apparatus and itself has at least one roller so that the apparatus as a whole may be guided over the floor to be cleaned in the manner of a three- or four-wheeled buggy Since, in addition, the spray and suction nozzle unit is designed in accordance with the invention to be detachably fixed to the buggy for lateral placement, the unit can be displaced so far to one side or the other that, by pushing the buggy along a wall, the floor can be uniformly cleaned or otherwise treated right up to the wall.

Another advantage of the invention is that the spray and suction nozzle unit has its own roller which guarantees a uniform, optimal pitch angle both of the spray nozzles and of the suction nozzles. Accordingly, depending on the type of floor to be treated, it is possible to use a separate spray/suction unit or to adjust the nozzles to the optimal pitch angle before commencing cleaning.

According to another aspect of the invention, the cleaner apparatus according to the invention comprises a steering handle having an integrated cable hook for tidily storing the power cable when the apparatus is not in use or as a carrying hook for a basket or the like. Where a U-shaped handle is provided for pushing the apparatus, the cable hook is best integrated in the two arms of the U-shaped handle.

To ensure that the container for the cleaning preparation, i.e., the wash liquor tank, may be filled directly from a faucet thus overcoming the inconvenience of having to carry a bucket, the container is equipped in accordance with the invention with an extendable hose having a filling nozzle designed to be directly connected to a faucet. In this way, the pressure pump is also prevented from being blocked or damaged by dirt or sediment entering the container from a bucket.

Finally, in another advantageous embodiment of the invention, a tube is built into the wash liquor tank, extending to the bottom thereof, for sucking up the residual liquor. This eliminates the need for additional emptying valves which, in practice, have always led to leaks.

BRIEF DESCRIPTION OF THE DRAWINGS

Illustrations of embodiments of the invention are described in detail in the following with reference to the accompanying drawings wherein.

DETAILED DESCRIPTION OF THE DRAWINGS

Figure 1:
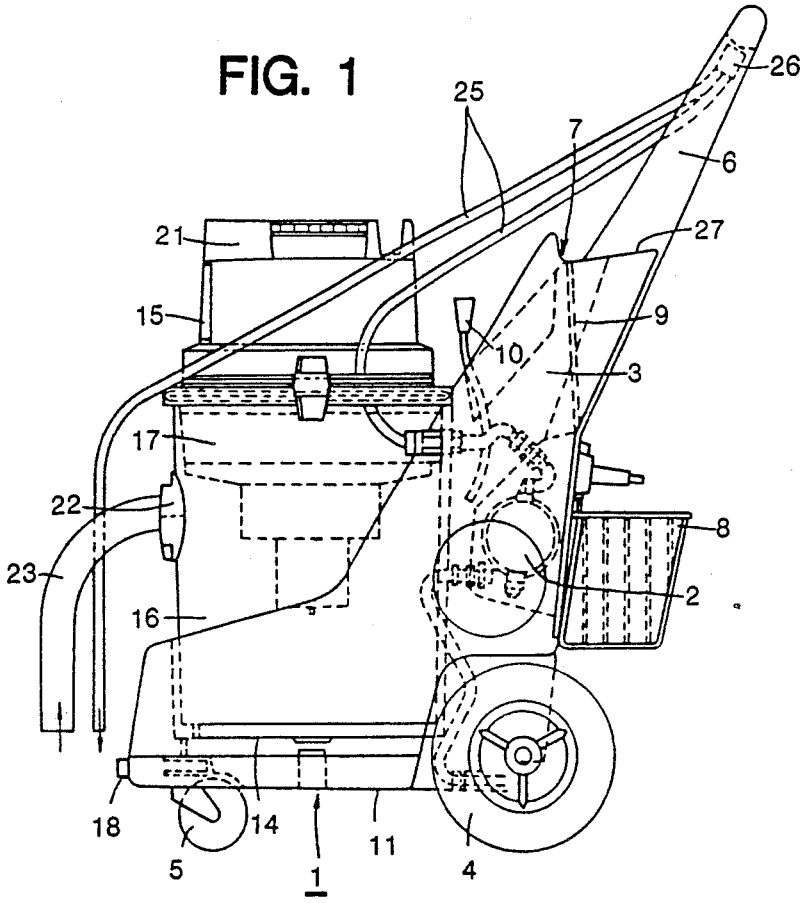
FIG. 1 is a side elevation view, partly in section, of a mobile cleaner apparatus in accordance with this invention.
Figure 2:
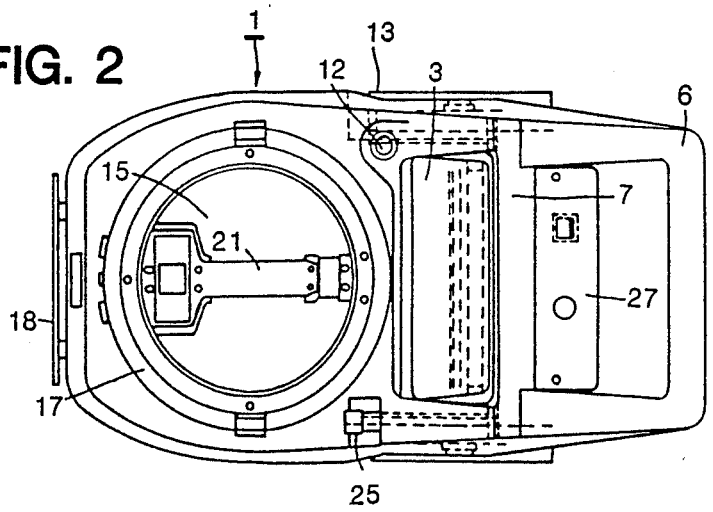
FIG. 2 is a plan view of the cleaner apparatus shown in FIG. 1.

The cleaner apparatus shown in FIGS. 1 and 2 comprises a chassis generally denoted by the reference 1 with a container 3 for a cleaning preparation integrated therein together with a pressure pump 2. In the embodiment illustrated, the chassis 1 comprises a pair of supporting wheels 4 and a pair of steering wheels 5 and also a U-shaped handle 6 with a hook-shaped cable rest 7 integrated in the top of the arms of the handle and joining the arms together. The cable rest 7 may also be used for the suspension of a carrying basket 8 with a corresponding hook 9. The container 3 for the cleaning preparation comprises an extendable hose with a filling nozzle 10 which may be directly connected to a water faucet. In addition, a tube 12 is provided in the container 3, extending to the bottom thereof, for the removal by suction of residual liquor.

Figure 3:
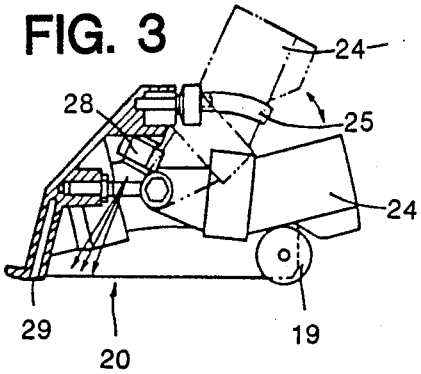
FIG. 3 is a side elevation view of a spray/suction unit for attachment to the cleaner apparatus shown in FIG. 1.

A salient feature of the chassis 1 is a holder 14 for a suction unit generally denoted by the reference 15 with an integrated soil container 16 and suction pump 17 and also with a coupling means 18 in the illustrated embodiment, for fastening a spray and suction nozzle unit 20 having its own roller 19 (FIG. 3). The suction unit 15, which is designed to be lifted out from its position in the holder 14 of the chassis 1, for example by a handle 21, is connected by a suction hose 23 extending from its intake stub 22 to the corresponding suction connection 24 (FIGS. 3–5) of the spray and suction nozzle unit 20 when the latter is fastened to the coupling means 18. Between the spray and suction nozzle unit 20 and the chassis 1, there is another connecting line, namely the pressure line 25 (FIGS. 3–5) of the pressure pump 2 pumping the cleaning preparation from the container 3. The pressure line 25 can be passed through a control valve 26 (FIG. 1) provided in the handle 6, by which it is possible individually to regulate the quantity of cleaning preparation sprayed on. In addition, the handle 6 may be fitted with a switch panel 27 with control buttons for the various units.

Figure 4:
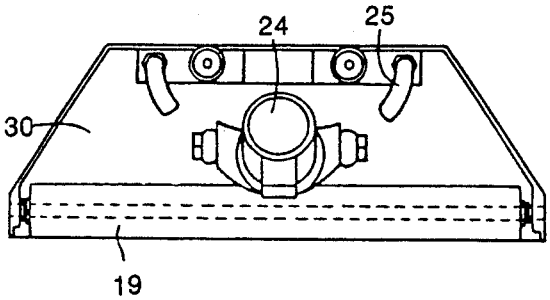
FIG. 4 is a rear view of the spray/suction unit shown in FIG. 3.
Figure 5:
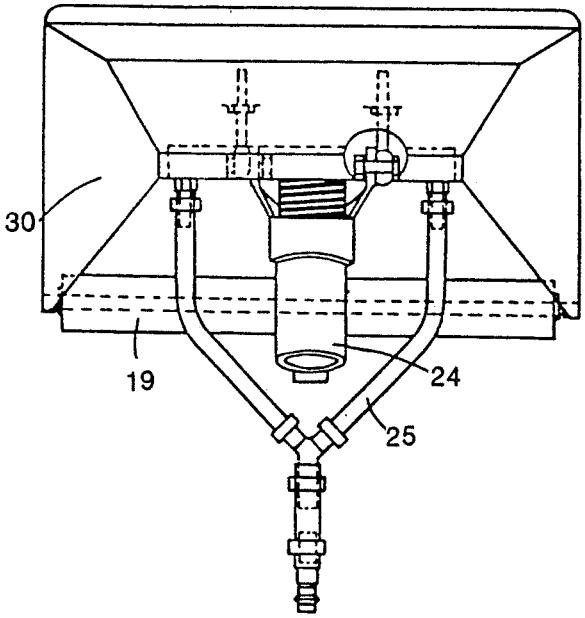
FIG. 5 is a plan view of the spray/suction unit shown in FIG. 3 or 4.

The actual spray and suction nozzle unit 20 is shown in detail in FIGS. 3 to 5. It comprises a roller 19 or a pair of rollers for determining the distance between, and the pitch angle of, the spray nozzle 28 and the suction lips 29. Basically, it is possible to equip the chassis with only the one pair 4 of supporting wheels and to design the roller 19 of the spray and suction nozzle unit 20 as the sole steering roller for the entire cleaner apparatus.

The spray and suction nozzle unit has an outlet, namely a spray nozzle 28, which in operation is coupled to the pressure line 25, and an inlet, namely a suction lip 29, which in operation is connected via its suction connection 24 and the suction hose 23 to the intake stub 22 of the suction unit 15. The spray and suction nozzle unit 20 having a roller 19 in the embodiment illustrated is fitted with a housing or hood 30 which covers the nozzles and suction lips from above and on the sides and which always guides the spray jets onto the floor.

A salient feature of the spray and suction nozzle unit according to the invention at its connection to the chassis 1 lies in the lateral displaceability and adjustability of the nozzle unit whereby the nozzle unit can be moved to the right or left in relation to the chassis and, hence, can be directed into a corner between the wall and floor of a room.

Figure 6:
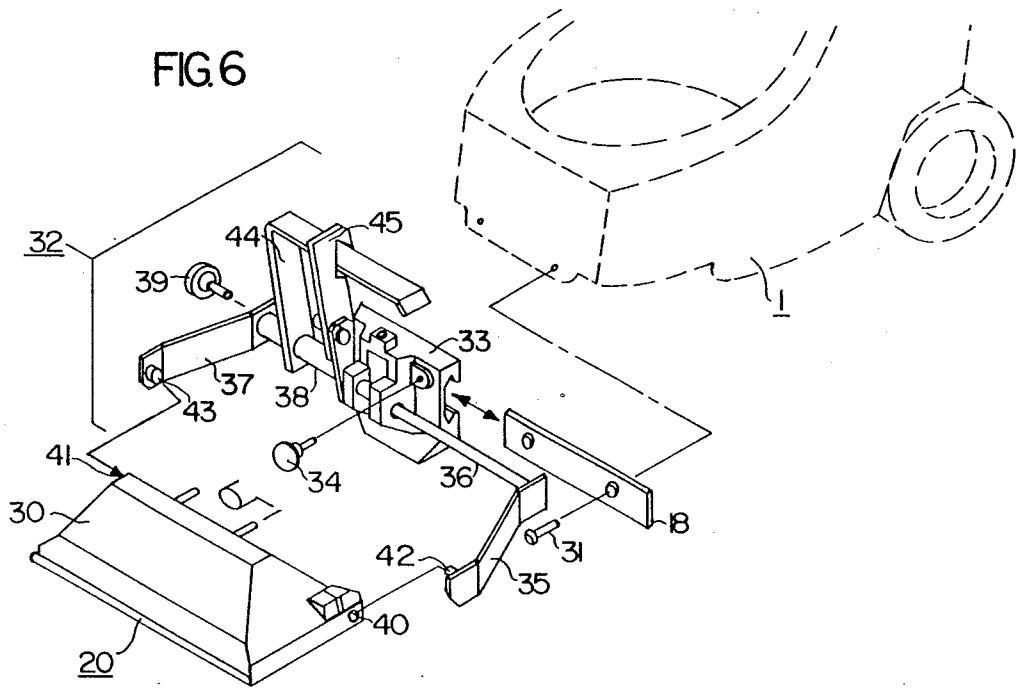
FIG. 6 illustrates the means for coupling the spray/-suction unit to the chassis of the cleaner apparatus.

Thus, in this regard, reference is made to FIG. 6 which shows spray and suction unit 20 detached from the chassis 1 of the cleaner apparatus. In FIG. 6, coupling means 18 may readily be seen to comprise a fastening rail or bar for attachment to the lower front portion of the chassis of the cleaner apparatus by means of screws 31.

The spray and suction nozzle unit 20 is attached to the fastening rail or bar by means of a coupling device generally denoted as coupling means 32. Coupling means 32 comprises a clamp block 33 having a groove (see arrows) therein designed to slide over and onto the fastening rail or bar of coupling means 18. Clamp block 33 may be clamped onto the fastening rail or bar at any desired central or lateral position by means of screw 34. Coupling means 32 also comprises a mounting frame in the form of lever 35 having a rod 36 which passes through a bore in clamp block 33. At the opposite end of rod 36 is another lever 37 connected to a tubular shaft 38.

Tubular shaft 38 is fitted onto rod 36, and lever 35 and lever 37 are drawn together and secured by screw 39. The side of housing 30 of spray and suction nozzle unit 20 has holes 40 and 41 therein to accommodate pins 42 and 43 of levers 35 and 37. Thus, pins 42 and 43 are inserted into holes 40 and 41, and levers 35 and 37 are secured by screw 39 to attach spray and suction nozzle unit 20 to coupling means 32.

As thus mounted on clamp block 33, levers 35 and 37 can be rotated in an upward and downward direction to alter the height of spray and suction nozzle unit 20, i.e., to adapt to uneven floor surfaces. This is accomplished by lever 44 which is fixed to shaft 38. When lever 44 is pivoted upwards, levers 35 and 37 are raised upwards and also raise upward spray and suction nozzle unit 20 along with them. To secure lever 44 in an upright position, lever 44 is inserted into latch 45 which engages onto fastening rail or bar of coupling means 18. When it is desired to move spray and suction nozzle unit 20 to a lateral position, latch 45 is disengaged, screw 34 is loosened and clamp block 33 is slid along fastening rail or bar of coupling means 18. After re-securing the foregoing, the cleaner apparatus is again ready for use.

According to the foregoing, the cleaner apparatus according to the invention is extremely versatile and may be used as a spray extractor in the true sense, as a dry vacuum cleaner with the possibility of installing a microfilter, as a wet vacuum cleaner and as a foam cleaner for cleaning horizontal surfaces. By virtue of the roller of the spray and suction nozzle unit, the apparatus may be effortlessly used for cleaning even relatively large surfaces because it merely has to be pushed as the pitch angle of the spray nozzles and suction lips required for an optimal result may be established in advance. In this regard, the nozzle unit is distinguished by ergonomically smooth rolling both during spraying and during suction and by the possibility of being raised and hence taken out of operation for crossing thresholds or at the edges of elevators.

If only the suction unit is required, it may readily be lifted out from the chassis using the integrated handle and equipped with an intake stub for sucking up soil and/or water. In either case, the cleaning result may be observed with the naked eye by providing the soil container at least partly with a transparent wall.

What is claimed is:

1. A mobile cleaner apparatus comprising a container for a cleaning preparation and an associated pressure pump which are integrated into a mobile and steerable chassis, said chassis having a steering handle and comprising a holder for a suction unit having an integrated soil container, a coupling means for fastening to the front side of said chassis a spray nozzle and suction nozzle unit having a roller, said coupling means comprising a fastening rail or bar fixed to and extending substantially across the entire lower front side of said chassis, said coupling means including a clamp block having a groove therein designed to slide over and onto said fastening rail or bar wherein said clamp block is provided with a screw to secure said clamp block to said fastening rail or bar, said coupling means being also provided with a mounting frame connected to the housing of said spray nozzle and suction nozzle unit, whereby said coupling means enables lateral displacement of said spray nozzle and suction nozzle unit with respect to said chassis, said spray nozzle being suitable for applying a cleaning preparation to a surface to be cleaned and said suction nozzle being suitable for sucking up the applied cleaning preparation.

2. A mobile cleaner apparatus as in claim 1 wherein said suction unit having an integrated soil container is removable from said chassis and may be used separately as a dry or wet vacuum cleaner.

3. A mobile cleaner apparatus as in claim 1 wherein said mounting frame comprises a lever having a rod passing through a bore in said clamp block, and at the opposite side of said frame, another lever connected to a tubular shaft which shaft fits over said rod to enable securing the two levers together by a screw.

4. A mobile cleaner apparatus as in claim 3 wherein said spray nozzle and suction nozzle unit is adapted to pivot upwards on said clamp block in relation to a floor surface to be cleaned.

5. A mobile cleaner apparatus as in claim 4 wherein said coupling means has a lever fixed to said tubular shaft to enable upward movement of said mounting frame and said spray nozzle and suction nozzle unit.

6. A mobile cleaner apparatus as in claim 5 wherein said coupling means has a latch to engage said lever when said mounting frame is in a raised position.

7. A mobile cleaner apparatus as in claim 1 wherein said soil container is made at least partly of transparent material.

8. A mobile cleaner apparatus as in claim 1 wherein a cable hook for storing a power cable or a carrying hook for a basket is built into said steering handle.

9. A mobile cleaner apparatus as in claim 8 wherein said steering handle is u-shaped.

10. A mobile cleaner apparatus as in claim 1 wherein said container for said cleaning preparation has an extendable hose with a filling nozzle for direct connection to a water faucet.

11. A mobile cleaner apparatus as in claim 1 wherein said container for said cleaning preparation is provided with a tube extending to the base of said container for removal therefrom of residual wash liquor.

12. A mobile cleaner apparatus as in claim 1 wherein said suction unit has a connection to said spray nozzle and suction nozzle unit.

* * * * *